United States Patent [19]

Pipkorn

[11] Patent Number: 4,672,905

[45] Date of Patent: Jun. 16, 1987

[54] BOAT HULL WITH CENTER V-HULL AND SPONSONS

[76] Inventor: Howard W. Pipkorn, 1622 Lake Johanna Blvd., Arden Hills, Minn. 55112

[21] Appl. No.: 873,267

[22] Filed: Jun. 6, 1986

Related U.S. Application Data

[63] Continuation of Ser. No. 675,533, Nov. 28, 1984, abandoned.

[51] Int. Cl.[4] ..... B63B 1/04

[52] U.S. Cl. ..... 114/56; 114/290

[58] Field of Search ..... 114/56, 57, 283, 292, 114/290, 291; D12/313, 314

[56] References Cited

U.S. PATENT DOCUMENTS

| | | | |
|---|---|---|---|
| D. 244,841 | 6/1977 | Nescher | D12/6 |
| 3,363,598 | 1/1968 | Mortrude | 114/56 |
| 3,996,869 | 12/1976 | Hadley | 114/56 |
| 4,091,761 | 5/1978 | Fehn | 114/290 |
| 4,192,248 | 3/1980 | Moyer | 114/56 |
| 4,193,369 | 3/1980 | Talamantes | 114/56 |
| 4,465,009 | 8/1984 | Wood et al. | 114/56 |

FOREIGN PATENT DOCUMENTS

| | | | |
|---|---|---|---|
| 1106441 | 3/1968 | United Kingdom | 114/56 |

*Primary Examiner*—Galen Barefoot
*Assistant Examiner*—Stephen P. Avila
*Attorney, Agent, or Firm*—Dorsey & Whitney

[57] ABSTRACT

An improved boat hull is provided that combines the handling characteristics of a V-bottom hull with the speed and acceleration characteristics of a tunnel hull boat. The boat hull hereof includes a V-shaped outer hull portion, and an opposed pair of narrow sponsons that depend downwardly from the gunwales to individual sponson base lines positioned between 5 degrees and two-thirds the V-hull dead rise angle, as measured relative to the horizontal from the apex of the V-hull portion.

6 Claims, 8 Drawing Figures

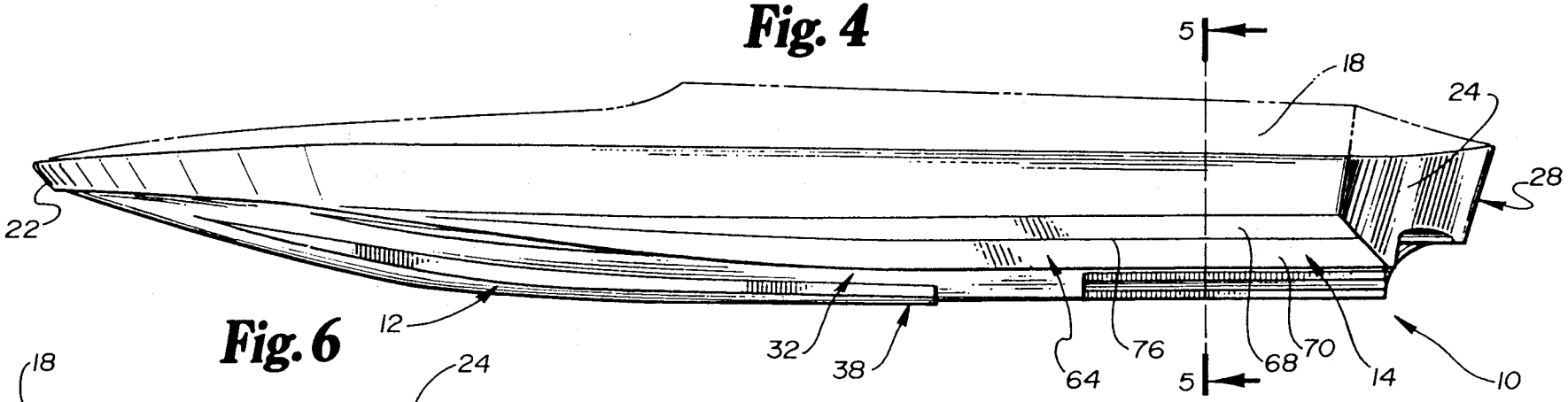
Fig. 4
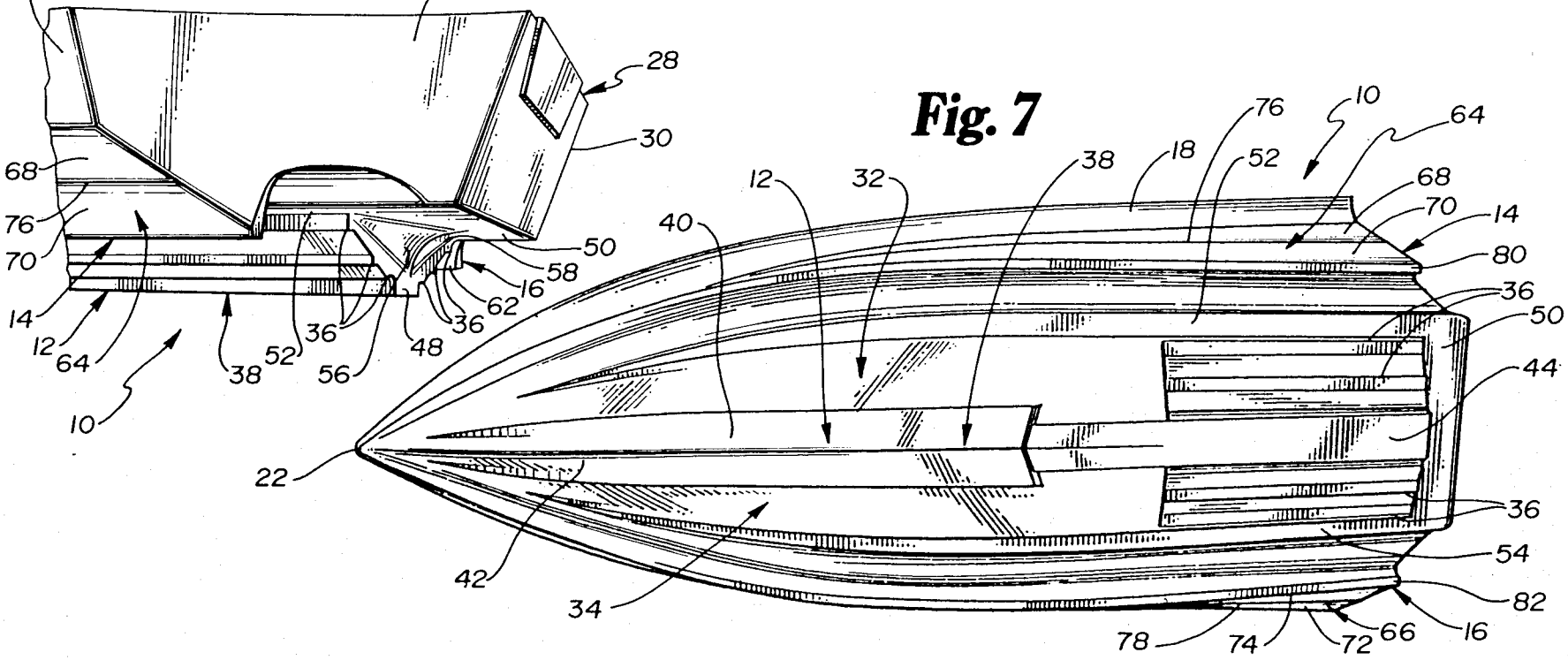
Fig. 7
Fig. 6

BOAT HULL WITH CENTER V-HULL AND SPONSONS

This application is a continuation of application Ser. No. 675,533 filed Nov. 28, 1984, and now abandoned.

TECHNICAL FIELD

This invention relates to high performance boat hull structures. In particular, it pertains to an improved hull structure which combines the handling characteristics of a V-bottom hull with the speed and acceleration characteristics of a tunnel hull boat.

BACKGROUND OF THE INVENTION

Tunnel hull boats are designed to trap air underneath the boat hull as the boat moves through water, thereby compressing the air and lifting the boat above the water line defined by the boat's natural buoyancy. The effect of lifting the boat decreases the boat's resistance through the water and allows for faster acceleration and greater boat speeds.

Conventional tunnel hull designs have inherently sacrificed handling characteristics for higher speed performance. In particular, the same hull design that has allowed for lifting the hull out of the water has inhibited banking of the boat when turned, and contributes to porpoising (up and down oscillation of the bow) while turning. Moreover, performance of conventional tunnel hull boats is load sensitive and sea state dependent. That is to say, heavy loads detract from the air capturing and speed enhancing ability of tunnel hull boats, and, as compared to the more traditional V-bottom hull boat, tunnel hull boats are less stable in choppy water.

A high performance boat that combined the speed and acceleration advantages of the tunnel hull with the handling characteristics and stability of the traditional V-bottom hull would be a decided advantage.

SUMMARY OF THE INVENTION

The improved boat hull in accordance with the present invention successfully combines the high performance capabilities of the tunnel hull with the handling and stability characteristics of the traditional V-bottom hull. The hull in accordance with the present invention includes a V-shaped center hull portion, and an opposed pair of narrow sponsons that depend downwardly from the gunwales to a sponson base line positioned between 5 degrees and two-thirds the V-hull dead rise angle, as measured relative to the horizontal from the apex of the V-hull portion. The above described positioning of the sponson base lines allows for banking of the boat when turned, yet provides an adequate air trap for tunnel hull performance. The sponsons' narrow width provides required stability without unduly increasing the wetted surface area of the overall hull. The sponson sidewalls are especially configured to present a reduced wetted perimeter with corresponding lower skin friction, promoting greater boat speeds at all power settings.

BRIEF DESCRIPTION OF THE DRAWINGS

FIG. 4 is a perspective view of the hull taken from the port beam;

FIG. 6 is a fragmentary, perspective view of the hull, taken from the port quarter;

FIG. 7 is a perspective view of the hull bottom, taken from a position slightly to port.

DETAILED DESCRIPTION OF THE DRAWINGS

Figure 1:
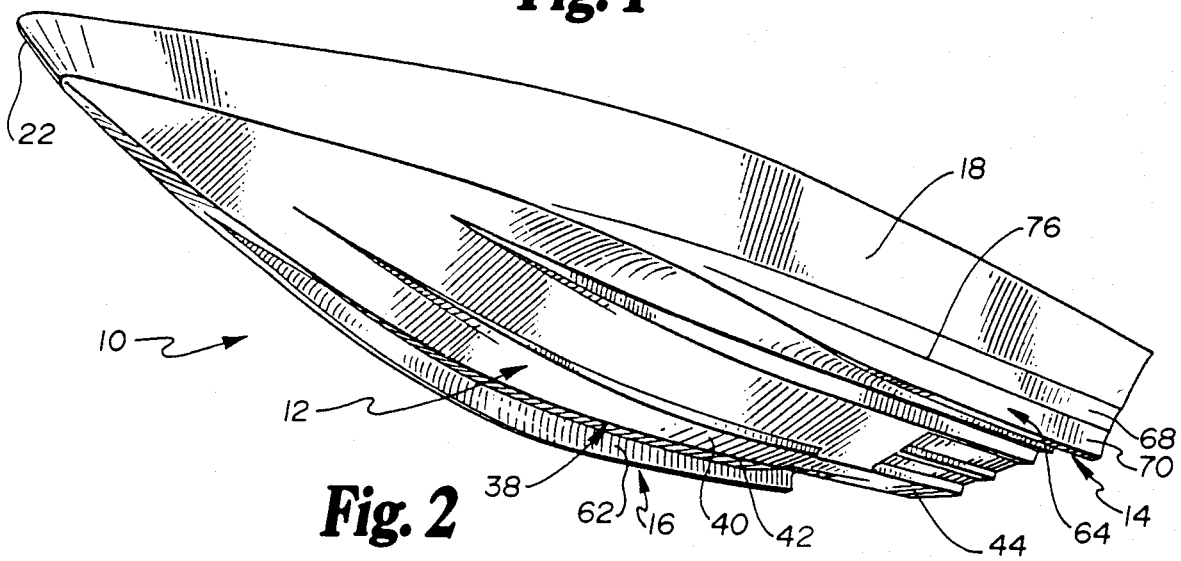
FIG. 1 is a perspective view of the boat hull in accordance with the present invention taken from the port bow.

Referring to the drawings, an improved hull 10 in accordance with the present invention broadly includes center V-hull portion 12, and a pair of opposed, generally parallel sponsons 14, 16 positioned to either side of the V-hull portion 12. The sponsons 14, 16 depend downwardly from respective opposed gunwales 18, 20. The sponsons 14, 16 extend rearwardly from points slightly aft of the bow 22 and terminate at inset portions 24, 26 of the stern 28. The stern 28 is comprised of inset portions 24, 26 and transom 30.

The V-hull portion 12 of hull 10 is defined by inclined panels 32, 34. The rearward portion of each panel 32, 34 is generally inset from the plane defined by the forward portion of each panel, but includes outwardly extending ribs that define a plurality of strakes 36.

Panels 32, 34 terminate at their lower edges along keel 38. The forward portion of keel 38 comprises a pair of narrow, longitudinally extending inclined panels 40, 42. The panels 40, 42 comprise outwardly extending projections from the main panels 32, 34. The rear portion of keel 38 comprises horizontally oriented, narrow, planar panel 44.

Figure 8:
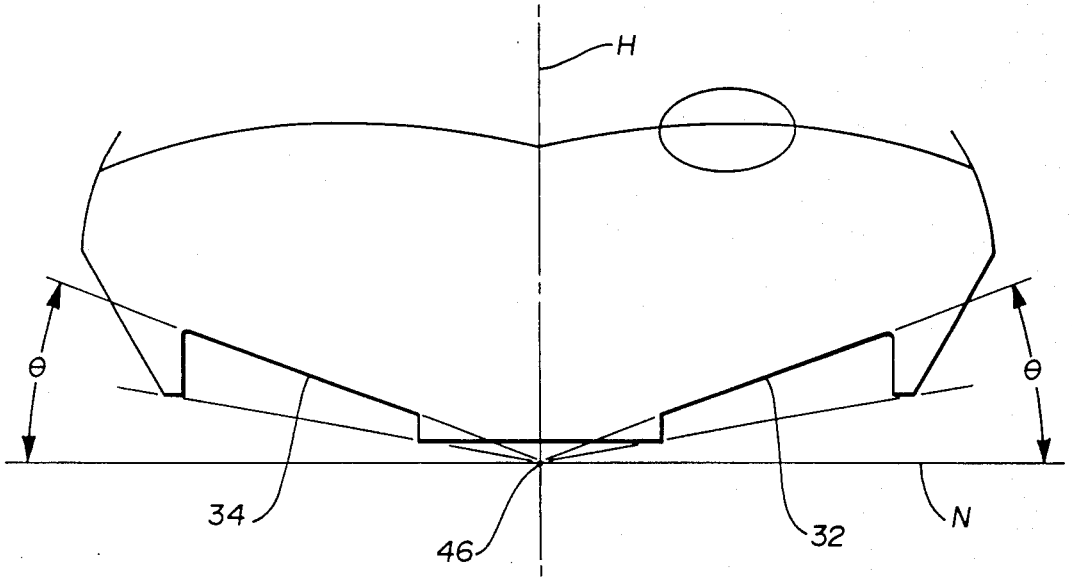
FIG. 8 is a schematic, transverse cross section of the hull.

The panels 32, 34 define the dead rise angle of the V-hull portion 12 of the boat hull 10. That is to say, and referring to FIG. 8, the extension of the planes defined by panels 32, 34 intersect along an imaginery line defining the apex 46 of the V-hull portion. The panels 32, 34 are symmetrically positioned about the hull center plane H. The V-hull dead rise angle theta is measured from the normal plane N containing the apex 46 and perpendicular to the hull center plane H, to the respective V-hull panel portion 32, 34. It will be appreciated that the angles defined by panels 32, 34 increase as the panels move forward from a point approximately midships on the hull. The V-hull dead rise angle is properly measured aft of the midship's point, where the angle defined by the panel is relatively constant.

The V-hull portion 12 terminates in a generally vertical rear wall 48, short of the transom 30. The generally horizontal bottom wall panel 50 extends rearwardly from the V-hull wall portion 38 to the transom 30. Moreover, the horizontal bottom wall 50 extends forwardly along the lateral edges of V-hull portion 12 to define opposed, generally horizontal marginal portions 52, 54. Generally arcuate panels 56, 58 interconnect the rear wall 48 and bottom wall 50.

Figure 2:
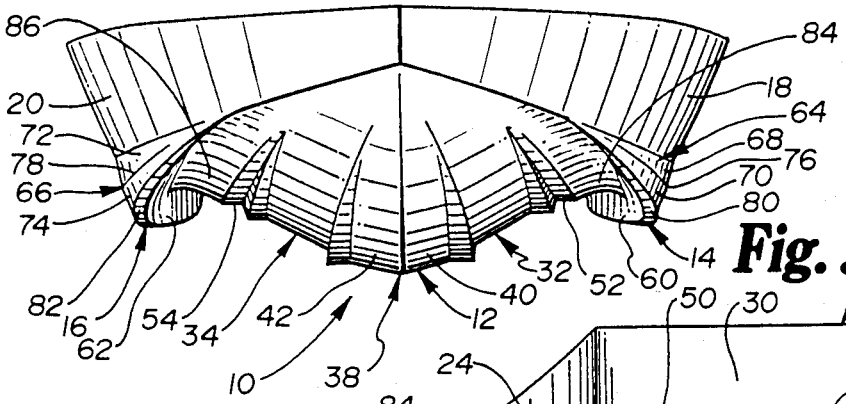
FIG. 2 is a front elevational view of the hull.

Sponsons 14, 16 extend forwardly from points coextensive with the plane defined by rear wall 48 to points slightly aft of the bow 22. Sponsons 14, 16 include generally upright inner sidewalls 60, 62, and generally inclined outer sidewalls 64, 66. The sponsons 14, 16 run generally parallel to each other along the after portion of the hull 10, and, as best depicted in FIG. 2 and FIG. 7, curve inwardly toward each other, following the curvature of the gunnels 18, 20, as they move forwardly on the hull 10. The sponson outer sidewalls 64, 66 each comprise two slightly concave panels 68, 70 (port sponson outer sidewall 64), and 72, 74 (starboard sponson outer sidewall 66) that define linear surface discontinuities 76, 78. The base of each sponson 14, 16 comprises a narrow, generally horizontal, bottom panel 80, 82. Referring in particular to FIG. 2, it will be seen that the bottom panels 80, 82 gradually rise upwardly as the sponsons 14, 16 approach the bow of the hull 10.

Generally arcuate tunnel top walls 84, 86 interconnect sponsons 14, 16 with the hull portion 12. The sponsons 14, 16, top walls 84, 86, and V-hull portion 12 define a pair of opposed, longitudinally extending tunnels 88, 90, with the water providing the tunnel bottom wall.

The unique handling characteristics of the hull 10 in accordance with the present invention are in large part due to the placement of the sponsons 14, 16 relative to the dead rise angle of the V-hull portion 12. The base lines of the sponsons 14, 16 are advantageously located no lower than five degrees above the horizontal as measured from the apex of the V-hull. Moreover, the sponson base lines are advantageously located no higher than two-thirds the dead rise angle of the V-hull.

The lower limit of the sponson base line is established by yaw stability requirements. The V-hull portion 12 inherently counteracts forces transverse to the forward path of travel of the boat, and maintains the boat in a single, forward direction. Lowering the sponson base line to a point lower than the described five degrees limit allows the natural buoyancy and upward planing force of the sponsons to counteract the inherent, positive yaw stability characteristic of the V-hull.

The upper limit of the sponson base line is established by the depth of the sponson required to provide an adequate air capturing and air-compressing tunnel. As will be appreciated by those skilled in the art, the cross section area of the forward end of a boat hull tunnel must be greater than the cross section area at the rear end of the tunnel for compression of air traveling down the tunnel as the boat travels through the water. The reduction in cross section area is provided in the present invention by the orientation of the tunnel top walls 84, 86 with the water line. That is to say, the top walls angle upwardly, from stern to bow, relative to the water line. The compression of air within the tunnel creates the desired lifting effect of the hull. It will further be appreciated that, as a boat travels through the water, the bow will rise, and, to provide the desired air compression effect, the leading edge of the sponson must be low enough to intersect the water line at a point far enough forward on the hull to define an air capturing tunnel of adequate length. On the other hand, it is not desirable to submerge any more of the sponson than is necessary to effect proper tunneling, in order to avoid unduly increasing the wetted hull perimeter and related skin drag. A sponson depth that is not higher than two-thirds the V-hull dead rise angle has been found to provide a tunnel of adequate length for air compression purposes, while minimizing the wetted surface area of the sponson.

Figure 3:
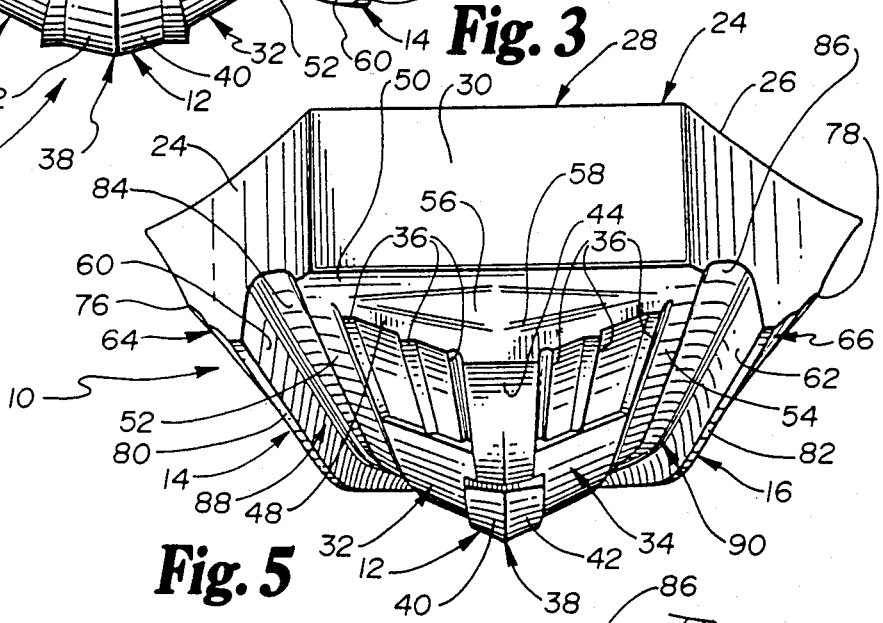
FIG. 3 is a perspective view of the hull, taken from the stern, slightly below the keel.
Figure 5:
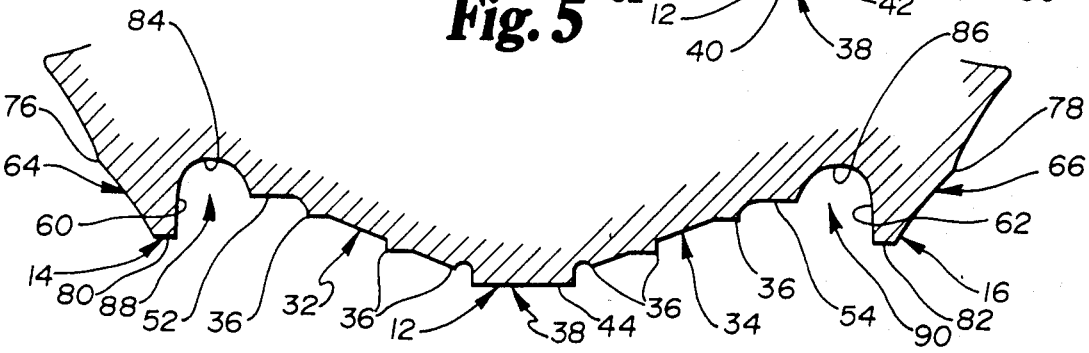
FIG. 5 is a sectional view taken along the line 5—5 of FIG. 4.

The shape of the sponsons 14, 16 is unique in several aspects other than the depth of their base lines 80, 82. First of all, as best depicted in FIGS. 3 and 7, the after portions of the sponsons 14, 16 are oriented generally parallel with the forward path of travel of the hull 10. The forward portions of the sponsons, however, follow the natural curvature of the gunnels 18, 20, and bend inwardly toward each other as they approach the bow 22 of the hull 10. In contrast, the sponsons of conventional tunnel hull boats have been oriented parallel to the forward path of travel of the boat along their entire length. The sponson shape in accordance with the present invention, however, recognizes the fact that the air attacking the V-hull portion 12 of the hull 10 is directed outwardly away from the center line of the boat. The curved forward portions of the sponsons 14, 16 are therefore better positioned to capture the deflected air and direct the air rearwardly through the hulls 88, 90.

The sponsons 14, 16 of the hull 10 in accordance with the present invention also differ from conventional sponson design in the shape of the inner and outer sidewalls 60, 64, 62, 66 of the sponsons 14, 16 respectively. Assuming a forward path of travel of the hull 10, a direct vertical rise of the sponson inner and outer sidewalls would provide for the least amount of wetted surface area. Assuming a curved path of travel when the boat is turned, a direct vertical rise of the inner sponson sidewall is again advantageous, since, as the boat banks in the direction of the turn, the inner sidewall of the sponson inboard of the turn will in effect scoop water, thereby minimizing the boat's transfer in the direction of the boat prior to the turn.

The width of sponson base panels 80, 82, and the preferred angle of the vertical rise of the outer sponson sidewalls is determined by several competing factors. In particular, the sponson sidewalls and bottom wall preferably defines a sponson width that provides a certain, limited amount of lift to the hull due to buoyancy and hydraulic planing effects. The lift provided by the sponsons enchances the boat's stability at rest and at slow speeds. At high speeds, however, the lift effect of the sponsons is preferably minimal, allowing the boat to bank in the manner of a traditional V-hull boat.

The maximum design width of the sponsons is determined by the planing effect provided by the sponsons as the boat moves through the water. Water flow past the sponsons can be either laminer or turbulent. The laminer or turbulent characteristic of the flow is a function of boat speed and geometry of the sponson; in particular, the geometry of the sponson effective base width.

The sponson effective base width is determined by the effective cross sectional area of the sponson in the plane of flow. Referring to the drawings, the effective cross sectional area of the sponson is a combination of the planar base panels 80, 82 width and the wetted portion of the sponson outer sidewalls (64, 66). Those skilled in the art will appreciate that, as the angle of each outer sidewall 80, 82 decreases, as measured from the horizontal, the area of the outer sidewall presented to the plane of water flow increases, and, accordingly, the planing effect of the sponson outer sidewall also increases.

The planing effect of the sponsons increases dramatically when the water flow shifts from laminer to turbulent. The sponsons in accordance with the present invention, therefore, are designed such that water flow across the sponsons remains laminer at typical operating speeds of 70–100 knots. A sponson effective base width of no greater than three inches will maintain laminer water flow at the above designated speeds. It will be appreciated that the addition to the sponson effective base width of the outer sidewalls is negligible when the angle of the outer sponson sidewalls, as measured to the horizontal, is no less than 60°. The sponson effective base width is in that (the preferred) case the width of the individual sponson base panels 80, 82.

The minimum width of the sponsons is determined by the need for the sponsons to provide some buoyancy to stabilize the boat when the boat is at rest. Buoyancy is a function of displaced water (volume of the sponson). As described above, the shape of the sponson inner sidewalls and the minimum angle of the sponson outer sidewall, relative to the horizontal, are determined by desired turning characteristics, and the planing effect, respectively. Moreover, the maximum sponson effective planar base width is determined by desired sponson lift characteristics. The length and depth of the sponsons are determined by the need to have an air tunnel of appropriate length (see above). The volume of the sponsons (i.e., water displacement capability) can therefore be controlled only by varying effective the planar base panel width, and by varying the sponson outer sidewall angle. Those skilled in the art will appreciate that the difference in overall volume created by varying the angle of the outer sponson sidewall between 60° and 90° (the preferred angle range for the outer sponson sidewall) is small. Effective volume of the sponsons, therefore, is primarily controlled by varying the width of sponson base panels 80, 82 up to three inches in width.

The sponson outer sidewalls 64, 66 each comprise a pair of panels 68, 70 and, 72, 74, that define a sponson surface discontinuity 76, 78 on respective outer sidewalls. The angle of the sponson outer sidewall, as described above, is measured relative to the lower panels 70, 74. The curvature of the panels 70, 74 is small, and can be ignored when measuring the sponson outer sidewall angle. The slight concave nature of the panels 70, 74, however, in combination with the surface discontinuities 76, 78, causes the flow of water upwardly along the sponson outer sidewalls to separate from the sponsons at the surface discontinuity. The separation of water flow from the sponsons decreases the hull wetted area, and, accordingly, decreases the resistance of the hull.

I claim:

1. A hull for a boat adapted for operation on a water surface, said hull having a bow and a stern, comprising:

a center V-hull portion extending substantially from said bow to said stern, and including a pair of angled panels symmetrically positioned about a hull center plane, said panels defining a V-hull apex line, said angled panels each defining a V-hull dead rise angle measured from said apex line relative to a normal plane containing said apex line and perpendicular to said hull center plane;

first and second opposed sponsons, positioned on opposite sides of said V-hull portion, each sponson including a lower most base;

opposed tunnel top wall surfaces operably connecting said panels with respective ones of said sponsons, each of said sponson bases being positioned no lower than five degrees above said normal plane as measured from said apex, and no higher than two-thirds of said V-hull portion dead rise angle, whereby said sponson bases remain substantially submerged when said boat attains operational speeds, and said tunnel top wall surfaces being no lower than said V-hull portion dead rise angle whereby said sponsons, said tunnel top wall surfaces, and said V-hull portion, together with said water surface, define a pair of air capturing tunnels while minimizing the wetted surface area of said sponsons.

2. A hull as claimed in claim 1, each of said sponsons including a generally vertically oriented inner sidewall, and an outer sidewall oriented between 60 degrees and 90 degrees to the horizontal.

3. A hull as claimed in claim 2, each of said sponsons further comprising a generally planar-based lower panel interconnecting said inner and outer sidewalls, said lower panel and said outer sidewall presenting a sponson effective base width to the flow of water across said sponsons, said effective base width being less than the width wherein said flow of water transitions from laminer to turbulent.

4. A hull as claimed in claim 1, said sponsons each having an after portion and a forward portion, said sponson after portions oriented generally parallel to said apex and said sponson forward portions curving inwardly from said sponson after portions toward said bow, whereby air deflected from said V-hull portion as said hull moves through the water is captured by said sponson forward portions and directed rearwardly through said tunnels.

5. A hull as claimed in claim 2, each of said sponsons including structure defining a surface discontinuity whereby water flowing upwardly along said outer sidewalls is separated from said sponson at said surface discontinuity.

6. A hull as claimed in claim 5, said surface discontinuities defined by the intersection of upper and lower outer sponson sidewall panels, said lower panels being slightly concave, thereby assisting the separation of water from said sponsons at said surface discontinuities.

* * * * *